US005097928A

United States Patent [19]

Enders et al.

[11] Patent Number: 5,097,928

[45] Date of Patent: Mar. 24, 1992

[54] POSITIONING DEVICE

[75] Inventors: Stephan Enders; Gregor Poertzgen, both of Koblenz, Fed. Rep. of Germany

[73] Assignee: Stabilus GmbH, Koblenz-Neuendorf, Fed. Rep. of Germany

[21] Appl. No.: 595,090

[22] Filed: Oct. 10, 1990

[30] Foreign Application Priority Data

Oct. 20, 1989 [DE] Fed. Rep. of Germany ..... 3934960

[51] Int. Cl.[5] ..... A47B 9/10

[52] U.S. Cl. ..... 188/300; 188/299; 267/64.11; 267/64.15

[58] Field of Search ..... 188/300, 299; 267/64.11, 64.15, 64.12

[56] References Cited

U.S. PATENT DOCUMENTS

| | | | |
|---|---|---|---|
| 3,930,565 | 1/1976 | Scheben et al. | 188/300 X |
| 4,245,826 | 1/1981 | Wirges | 188/300 X |
| 4,779,851 | 10/1988 | Bauer et al. | 267/64.12 |
| 4,856,762 | 10/1989 | Selzer | 267/64.12 |
| 4,989,698 | 2/1991 | Dony | 188/300 |

FOREIGN PATENT DOCUMENTS

| | | |
|---|---|---|
| 1650634 | 2/1970 | Fed. Rep. of Germany . |
| 1961079 | 2/1971 | Fed. Rep. of Germany . |
| 155478 | 7/1972 | Fed. Rep. of Germany . |
| 2620917 | 3/1989 | France . |
| 1164155 | 9/1969 | United Kingdom . |

*Primary Examiner*—Matthew C. Graham
*Attorney, Agent, or Firm*—Brumbaugh, Graves, Donohue & Raymond

[57] ABSTRACT

According to an illustrative example of the present invention a hydropneumatic positioning device comprises a tubular container. A hollow piston rod is guided through one end of the tubular container. A piston is connected with the piston rod within a cavity of the tubular container. The piston divides the cavity into two working chambers. The working chambers contain a liquid. Adjacent one of the working chambers, namely the working chamber remote from the piston rod, a compensating chamber is provided. This compensating chamber contains a pressurized gas and is separated from the adjacent working chamber by a floating separating wall. A flow passage extends through the piston between the two working chambers. A valve is allocated to the flow passage. The valve can be opened by an actuating rod extending through an axial bore of the hollow piston rod. The actuating rod extends beyond an outer end of the piston rod. An actuating signal transformer is fastened to the outer end of the piston rod. The signal transformer is constructed as a hydraulic press with a liquid chamber, an input piston, and an output piston. The output piston acts onto the outer end of the actuating rod and the input piston can be actuated manually.

16 Claims, 2 Drawing Sheets

POSITIONING DEVICE

BACKGROUND OF THE INVENTION

Positioning devices such as blockable gas springs and hydropneumatic springs are widely used, for example for height adjustment of tables and chairs. For blocking and unblocking such positioning devices a valve is provided between two fluid-filled working chambers of the positioning device. The valve is frequently operated through a rod or pin extending beyond a piston rod or a housing of the positioning device. The requirements as to the actuation of this actuating rod are different depending on the various constructions of which the positioning device forms a part. Sometimes a remote actuation is desired, sometimes a direct actuation of the piston rod is possible, sometimes a long actuation path is acceptable and a low actuation force is required. In other situations a high actuation force is available and a short actuation path is required.

STATEMENT OF THE PRIOR ART

From German patent 1 554 478 a gas spring is known with a cylinder and a piston rod extending inwards and outwards of the cylinder. A piston is connected with the piston rod within the cylinder. The piston separates the cavity within the cylinder into two working chambers which are both filled with a pressurized gas. A flow passage is provided for selectively connecting and separating the two working chambers from each other. This flow passage extends across the piston. A valve member is provided within an axial bore of the piston rod. For selectively opening and closing the flow passage an actuating piston is provided adjacent the outer end of the piston rod within the bore thereof. A liquid filling is provided between the valve member and the actuating piston. An actuating force exerted on the outer end of the input piston is transmitted through the liquid filling to the valve member.

According to another embodiment disclosed in German patent 1 554 478 the bore of the piston rod is closed adjacent the outer end thereof. The bore of the piston rod is connected through a flexible tube to a pressure generator in which pressure may be generated by pressing an input piston into a pressure chamber connected with the flexible conduit.

OBJECT OF THE INVENTION

It is a primary object of the present invention to provide a positioning device which is easily accessible to different kinds of actuation. More particularly it is an object of the present invention to provide a positioning device in which an actuating force for blocking and unblocking can be selectively applied either directly at the location of the positioning device or by remote control.

Further it is an object of the present invention to provide a positioning device in which actuation is selectively possible with small actuating force and long actuating path, or with high actuating force and short actuating path.

It is a further object of the present invention to provide a positioning device which can be easily modified in accordance with the respective requirements of different cases of application.

SUMMARY OF THE INVENTION

A positioning device comprises a housing unit having an axis and a piston rod axially extending inwards and outwards of the housing unit. A piston unit is connected to the piston rod within the housing unit. The piston rod and the piston unit form a piston-piston rod unit. The piston unit separates two working chambers from each other within the housing unit. The working chambers contain a fluid and are interconnected by a fluid passage. The fluid passage is selectively closable and openable by valve means allocated to the fluid passage. The valve means are actuable by an actuating pin guided within and projecting beyond one of the housing unit and the piston-piston rod unit. An actuating signal transforming unit is rigidly connected to the respective one of said housing unit and said piston-piston rod unit. The actuating signal transforming unit has input means for applying an input signal and output means acting on the actuating pin.

Such a positioning device may be used without the actuating signal transforming unit, in which case an actuating force is directly introduced into the actuating pin. Alternatively, a selected actuating signal transforming unit may be fastened to the housing unit or the piston-piston rod unit. According to the selection of the actuating signal transforming unit one can enable direct or remote control, actuation with small actuation force and long actuation path or actuation with high actuation force and short actuation path.

The actuating signal transforming unit may have an adapter housing fastened to the respective one of said housing unit and said piston-piston rod unit outside said housing unit. This adapter housing may be fastened to the respective one of said housing unit and said piston-piston rod unit by screw means. For example, the adapter housing may have internal thread means engaging external thread means of the respective one of said housing unit and said piston-piston rod unit.

The actuating signal transforming unit may be constructed as a type of hydraulic press comprising a liquid filled transforming chamber with an input piston and an output piston. Both said input piston and said output piston extend with respective first ends into the liquid filled transforming chamber. The output piston has a second end acting on the actuating pin.

If a high actuation force is acceptable and a short actuation path is desired, the output piston may have a smaller effective cross-sectional area than the input piston.

If, on the other hand, a low actuation force is required and a long actuation path is acceptable, the output piston may have a larger effective cross-sectional area than said input piston.

According to a further embodiment the actuating signal transforming unit comprises a solenoid with an electromagnetic coil and an armature which acts on the actuating pin. The electromagnetic coil has electric connection means for being connected to an electric power source.

The positioning device can be easily incorporated in a respective construction if the actuating signal transforming unit is provided with mechanical connection means for being connected to a respective structural member.

As mentioned above, it is of considerable advantage if the actuating pin extends outwards of the respective one of said housing unit and said piston-piston rod unit for the event that a direct actuation of the actuating pin is desired. In such case it is nevertheless possible to easily connect the actuating signal transforming unit with the housing unit or the piston-piston rod unit, if the actuating signal transforming unit comprises a cavity accommodating an outer end portion of said actuating pin.

A most simple and compact embodiment of a positioning device according to this invention is obtained if a respective one of the housing unit and the piston-piston rod unit has a terminal portion substantially coaxial with the axis of said housing unit. The actuating pin can extend through a bore of this terminal portion and beyond an outer end of this terminal portion. The terminal portion may be provided with external thread means. The signal transforming unit may have a substantially tubular adapter housing. The substantially tubular adapter housing is substantially coaxially fastened to the terminal portion by internal thread means engaging said external thread means of said terminal portion. In the adapter housing a substantially central cavity accommodates an end portion of the actuating pin. In the adapter housing there is further provided a liquid filled transforming chamber axially adjacent the cavity. This transforming chamber is closed by a cover member adjacent an end of the adapter housing remote from the respective one of said housing unit and said piston-piston rod unit. An axial bore extends between the cavity and the transforming chamber. An output piston is sealingly guided through said axial bore between said cavity and said transforming chamber. The output piston is substantially aligned with the actuating pin and has one end within said cavity and another end within said transforming chamber. A further bore extends through said cover member between said transforming chamber and atmosphere. An input piston is sealingly guided within said further bore and has one end within said transforming chamber and another end outside said cover member. The cover member may be provided with fastening means for being fastened to a respective structural member.

In the case of an electromagnetic actuation a most simple and compact construction may be obtained as follows:

A respective one of said housing unit and said piston-piston rod unit has a terminal portion substantially coaxial with the axis of the housing unit. The actuating pin extends through a bore of this terminal portion and beyond an outer end thereof. This terminal portion is provided with external thread means. The signal transforming unit has a substantially tubular adapter housing. This adapter housing is substantially coaxially fastened to the terminal portion by internal thread means engaging the external thread means of the terminal portion. The adapter housing has a substantially central cavity accommodating an end portion of the actuating pin. The adapter housing further accommodates a solenoid within a solenoid chamber axially adjacent the cavity. The solenoid chamber is provided with a cover member. This cover member may be provided with electric connectors for connecting the solenoid with an electric power source. The cover member may be provided with fastening means for being fastened to a respective structural member of the construction of which the positioning device forms a part.

BRIEF DESCRIPTION OF THE DRAWINGS

The invention will be explained in greater detail hereinafter with reference to embodiments shown in the accompanying drawings in which.

DETAILED DESCRIPTION OF THE PREFERRED EMBODIMENTS

Figure 3:
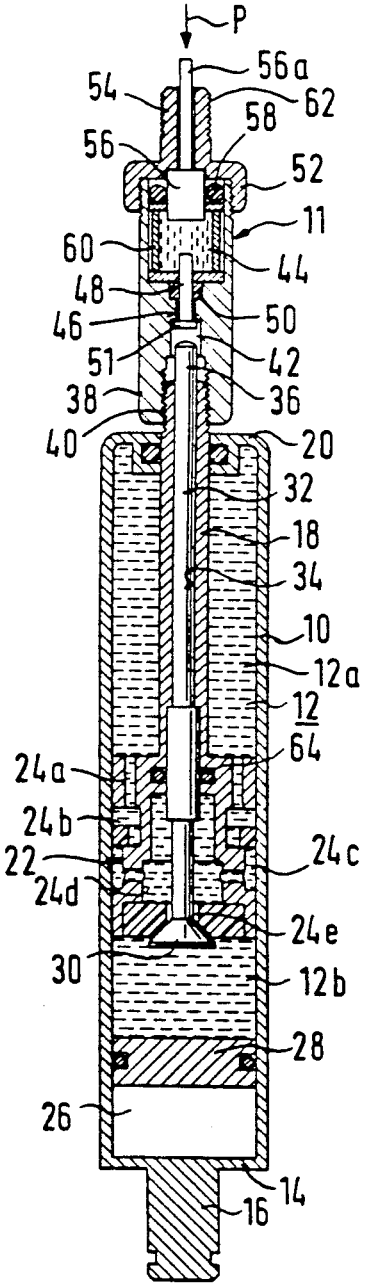
FIG. 3 shows a hydropneumatic positioning device with an actuating signal transforming unit according to FIG. 1 fastened to the outer end of a piston rod.

In FIG. 3 the positioning device comprises a cylinder 10 which defines a cavity 12 therein. The cylinder 10 has a lower end wall 14 with a connecting bolt 16 for being connected to a first structural member of a construction not shown. A piston rod 18 sealingly extends through an upper end wall 20 of the cylinder member 10. A piston unit 22 is connected with the piston rod 18 within the cavity 12. A flow passage 24*a*, 24*b*, 24*c*, 24*d*, 24*e* extends across the piston unit 22 and connects two working chambers 12*a* and 12*b*, which are separated from each other by the piston unit 22. The working chambers 12*a* and 12*b* are filled with a liquid. A compensation chamber 26 is provided adjacent the working chamber 12*b* and separated therefrom by a floating piston 28. The compensation chamber 26 is filled with a pressurized gas. The flow passage 24*a* to 24*e* is closed by a valve member 30. This valve member 30 is openable by an actuating rod 32 which extends through an axial bore 34 of the piston rod 18. The upper end portion 36 of the actuating rod 32 extends beyond the upper end of the piston rod 18. A tubular adapter housing 38 is screwed to the upper end portion of the piston rod 18 by thread means 40. The end portion 36 of the actuating rod 32 extends into a cavity 42 of the adapter housing 38. In the adapter housing 38 there is provided a liquid filled chamber 44. A bore 46 extends from the cavity 42 to the liquid filled chamber 44. An output piston 48 is sealingly guided within said bore 46 by a sealing ring 50. A head portion 52 of the output piston 48 is opposite to the end portion 36 of the actuating rod 32. A cover member 52 is screwed on the upper end of the tubular adapter housing 38. This cover member is provided with a hollow axial extension 54 in which a piston rod 56*a* of an input piston 56 is guided. The input piston 56 is sealingly guided by a sealing ring 58 which is supported by a spacer sleeve 60. The tubular extension 54 is provided with an external thread 62 which can be fastened to a further structural member of the respective construction. The actuating rod 32 is sealed against the bore 34 by a sealing ring 64.

Figure 1:
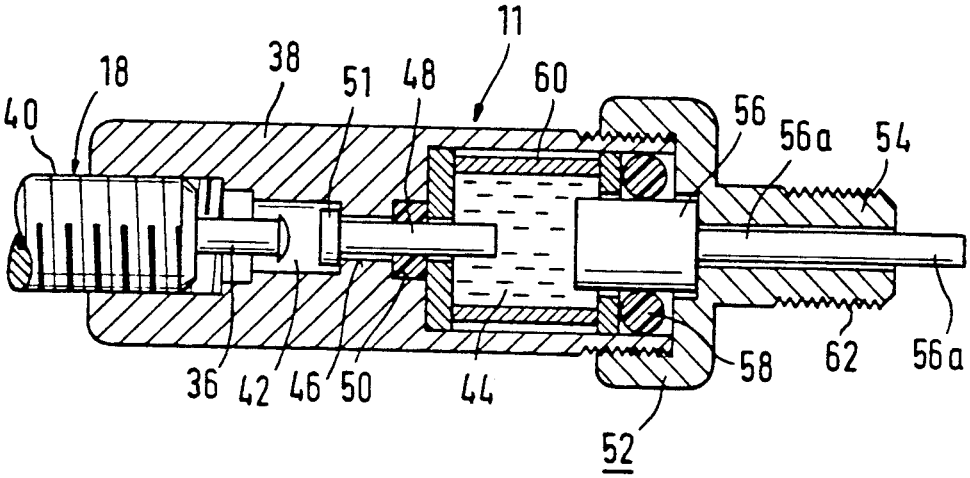
FIG. 1 shows a hydraulic press type actuating signal transforming unit.

The valve member 30 is biased into closing position by the liquid pressure within the working chamber 12*b*. For opening the valve member 30 an actuating force P is applied to the input piston rod 56*a*. As a result thereof, the output piston 58 is urged downwards through the liquid 44 and acts upon the upper portion 36 of the actuating rod 32. The transmission ratio of the hydraulic press type actuating signal transforming unit 11 depends on the effective cross-sectional areas of the input piston 56 and the output piston 48 exposed to the liquid filling within the liquid chamber 44. In the illustrated embodiment the effective cross-sectional area of the input piston 56 is larger than the effective cross-sectional area of the output piston 48. Only a small actuating path is necessary and correspondingly high actuating force for moving the valve member 30 towards its opening position. The hydraulic press type actuating signal transforming unit 11 is shown in an increased scale in FIG. 1.

Figure 2:
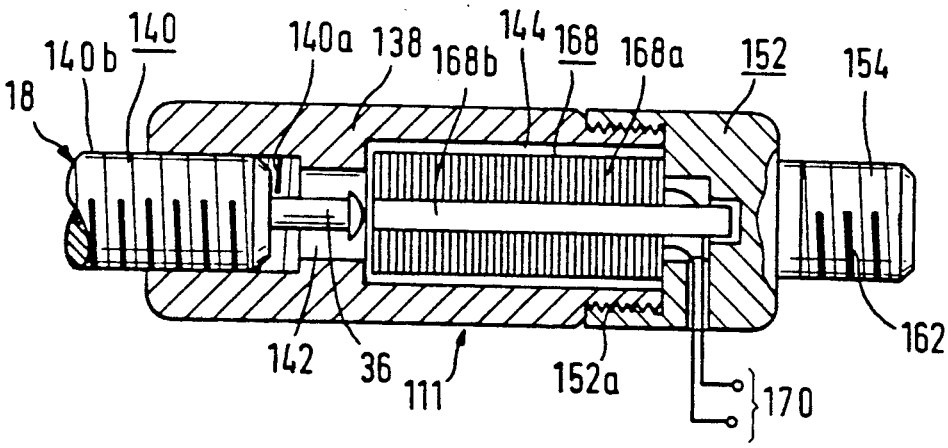
FIG. 2 shows a solenoid type actuating signal transforming unit.

The hydraulic press type actuating signal transforming unit 11 may be replaced by a solenoid type actuating signal transforming unit as shown in FIG. 2. In FIG. 2 one recognizes the upper end portion of the piston rod 18 of FIG. 3 and the upper end portion 36 of the actuating rod 32. An adapter housing 138 is fastened to the piston rod 18 by thread means 140, namely internal thread means 140*a* of the adapter housing 138 and external thread means 140*b* of the piston rod 18. The end portion 36 of the actuating rod again is accommodated by a cavity 142. A solenoid chamber 144 of the adapter housing 138 accommodates a solenoid 168 with an electromagnetic coil 168*a* and an armature 168*b*. The solenoid chamber 144 is closed by a cover member 152 which is fixed to the solenoid housing 138 by thread means 152*a*. Electric conductors 170 for the energization of the electromagnetic coil 168*a* extend through the cover member 152. The cover member 152 is provided with a fastening extension 154 with external thread means 162 for connecting the positioning device with a structural member of the respective construction. The valve member 30 of FIG. 3 is opened by energization of the solenoid 168 which urges the armature 168*b* towards the end portion 36 of the actuating rod 32.

Figure 4:
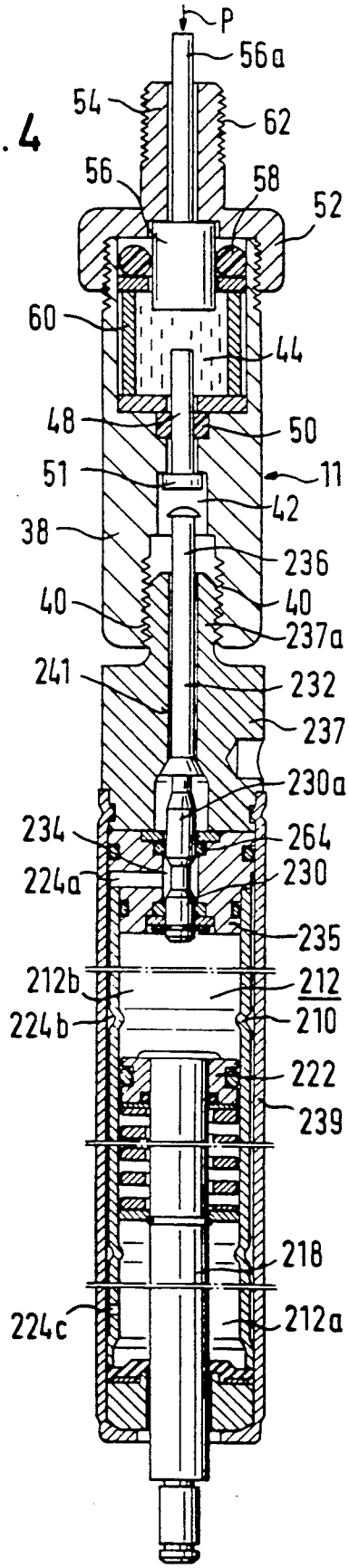
FIG. 4 shows a gas spring with an actuating signal transforming unit of FIG. 1 fastened to the housing.

In the embodiment of FIG. 4 the hydraulic press type actuating signal transforming unit 11 is combined with a gas spring. This gas spring comprises a cylinder 210 with a piston rod 218 and a piston unit 222 fastened to the piston rod 218. The piston 220 divides the cavity 212 into two working chambers 212*a* and 212*b*. The working chambers 212*a* and 212*b* are filled with pressurized gas and are interconnected by a flow passage 224*a*, 224*b*, 224*c*. The flow passage 224*a* to 224*c* is closed by a valve member 230. The valve member 230 is provided with a valve shaft 230*a* which is sealingly guided by a sealing ring 264 against a bore 234 of a plug member 235 closing the upper end of the cylinder member 210. The valve shaft 230*a* is actuated by an actuating rod 232 which has an end portion 236 accommodated by the cavity 42. The adapter housing 38 is fixed by the thread means 40 on an end portion 237*a* of a plug member 237. The plug member 237 is fastened to the upper end of an outer sleeve 239 surrounding the cylinder member 210. The actuating rod 232 extends through a bore 241 of the plug member 237.

The valve member 230 is biased towards its closing position by the pressure of the pressurized gas within the working chamber 212*b*. The valve member 230 is moved towards its opening position by downward movement of the actuating rod 232. This downward movement is obtained by exerting an actuating force P onto the input piston 56*a* which results in a downward movement of the output piston 48 against the upper end portion 236 of the actuating rod 232.

While specific embodiments of the invention have been shown and described in detail to illustrate the application of the inventive principles, it will be understood that the invention will be embodied otherwise without departing from such principles.

The reference numerals in the claims are only used for facilitating the understanding and are by no means restrictive.

What is claimed is:

1. A positioning device comprising:

a housing unit (10, 210) having an axis;

a piston rod (18, 218) axially extending inwards and outwards of said housing unit (10,210);

a piston unit (22, 222) connected to said piston rod (18, 218) within said housing unit (10, 210), said piston rod (18, 218) and said piston unit (22, 222) forming a piston-piston rod unit (18, 22; 218, 222), said piston unit (22, 222) separating two working chambers (12*a*, 12*b*; 212*a*, 212*b*) from each other within said housing unit (10, 210), said working chambers (12*a*, 12*b*; 212*a*, 212*b*) containing a fluid, said working chambers (12*a*, 12*b*; 212*a*, 212*b*) being interconnected by a fluid passage (24*a* to 24*e*; 224*a* to 224*c*), said fluid passage (24*a* to 24*e*; 224*a* to 224*c*) being selectively closable and openable by valve means (30, 230) allocated to said fluid passage (24*a* to 24*e*; 224*a* to 224*c*), said valve means (30, 340) being actuable by an actuating pin (32; 232) guided within and projecting beyond one of said housing unit (210) and said piston-piston rod unit (18, 22); and an actuating signal transforming unit (11) being rigidly connected to the respective one of said housing unit (210) and said piston-piston rod unit (18, 22), said actuating signal transforming unit (11, 111) having input means (56*a*, 56) for applying an input signal and output means (48) acting on said actuating pin (32, 232), said actuating signal transforming unit (11) comprising a liquid filled transforming chamber (44) having an input piston (56) and an output piston (48), both said input piston (56) and said output piston (48) extending with respective first ends into said liquid filled transforming chamber (44), said output piston (48) having a second end (52) acting on said actuating pin (32).

2. A positioning device comprising:

a housing unit (10, 210) having an axis;

a piston rod (18, 218) axially extending inwards and outwards of said housing unit (10, 210);

a piston unit (22, 222) connected to said piston rod (18, 218) within said housing unit (10, 210), said piston rod (18, 218) and said piston unit (22, 222) forming a piston-piston rod unit (18, 22; 218, 222), said piston unit (22, 222) separating two working chambers (12*a*, 12*b*; 212*a*, 212*b*) from each other within said housing unit (10, 210, said working chambers (12*a*, 12*b*; 212*a*, 212*b*) containing a fluid, said working chambers (12*a*, 12*b*; 212*a*, 212*b*) being interconnected by a fluid passage (24*a* to 24*e*; 224*a* to 224*c*), said fluid passage (24*a* to 24*e*; 224*a* to 224*c*) being selectively closable and openable by valve means (30, 230) allocated to said fluid passage (24*a* to 24*e*; 224*a* to 224*c*), said valve means (30, 230) being actuable by an actuating pin (32, 232) guided within and projecting beyond one of said housing unit and said piston-piston rod unit (18, 22) with a respective one of said housing unit (210) and said piston-piston rod unit (18, 22) having a terminal portion (237*a*) substantially coaxial with the axis of said housing unit (10, 210), said actuating pin (32, 232) extending through a bore of said terminal portion (237*a*) and beyond an outer end of said terminal portion (237*a*), said terminal portion (237*a*) being provided with external thread means; and an actuating signal transforming unit (11) being rigidly connected to the respective one of said housing unit (210) and said piston-piston rod unit (18, 22), said actuating signal transforming unit (11) having input means (56*a*, 56) for applying an input signal and output means (48) acting on said actuating pin (32, 232), said signal transforming unit (11) having a substantially tubular adapter housing (38), said substantially tubular adapter housing (38) being substantially coaxially fastened to the terminal portion (237*a*) by internal thread means engaging said external thread means of said terminal portion (237*a*), said adapter housing (38) having a substantially central cavity (42) accommodating an end portion (36, 236) of said actuating pin (32, 232), said adapter housing (38) further having a liquid filled transforming chamber (44) axially adjacent said cavity (42), said transforming chamber (44) being closed by a cover member (52) adjacent an end of said adapter housing (38) remote from the respective one of said housing unit (210) and said piston-piston rod unit (18, 22), with said signal transforming unit (11) having an axial bore (46) extending between said cavity (42) and said transforming chamber (44), an output piston (48) being sealingly guided through said axial bore (46) between said cavity (42) and said transforming chamber (44), said output piston (48) being substantially aligned with said actuating pin (32) and having one end within said cavity (42), and another end within said transforming chamber (44), and a further bore extending through said cover member (52) between said transforming chamber (44) and atmosphere, an input piston (56) being sealingly guided within said further bore and having one end within said transforming chamber (44) and another end (56*a*) outside said cover member (52).

3. The positioning device as set forth in claim 2, said cover member (52) being provided with fastening means (62) for being fastened to a respective structural member.

4. A positioning device comprising:

a housing unit having an axis;

a piston rod (18) axially extending inwards and outwards of said housing unit;

a piston unit connected to said piston rod (18) within said housing unit, said piston rod (18) and said piston unit forming a piston-piston rod unit, said piston unit separating two working chambers from each other within said housing unit, said working chambers containing a fluid, said working chambers being interconnected by a fluid passage, said fluid passage being selectively closable and openable by valve means allocated to said fluid passage, said valve means being actuable by an actuating pin (36) guided within and projecting beyond one of said housing unit and said piston-piston rod unit; and an actuating signal transforming unit (111) being rigidly connected to the respective one of said housing unit and said piston-piston rod unit, said actuating signal transforming unit (111) having input means (170) for applying an input signal and output means (168*b*) acting on said actuating pin (36) with the respective one of said housing unit and said piston-piston rod unit having a terminal portion substantially coaxial with the axis of said housing unit, said actuating pin (36) extending through a bore of said terminal portion and beyond an outer end of said terminal portion, said terminal portion being provided with external thread means (140), said signal transforming unit (11) having a substantially tubular adapter housing (138), said substantially tubular adapter housing (138) being substantially coaxially fastened to the terminal portion by internal thread means (140*a*) engaging said external thread means (140) of said terminal portion, said adapter housing (138) having a substantially central cavity (142) accommodating an end portion (36) of said actuating pin, said adapter housing (138) further accommodating a solenoid (168) within a solenoid chamber (144) axially adjacent said cavity (142) with said solenoid chamber (144) being provided with a cover member (152).

5. The positioning device as set forth in claim 4, said cover member (152) being provided with fastening means (162) for being fastened to a respective structural member.

6. A positioning device comprising:

a housing unit having an axis;

a piston rod (18) axially extending inwards and outwards of said housing unit;

a piston unit, connected to said piston rod within said housing unit, said piston rod (18) and said piston unit forming a piston-piston rod unit, said piston unit separating two working chambers from each other within said housing unit, said working chambers containing a fluid, said working chambers being interconnected by a fluid passage, said fluid passage being selectively closable and openable by valve means allocated to said fluid passage, said valve means being actuable by an actuating pin (36) guided within and projecting beyond one of said housing unit and said piston-piston rod unit (18); and an actuating signal transforming unit (111) being rigidly connected to the respective one of said housing unit and said piston-piston rod unit, said actuating signal transforming unit (111) having input means (170) for applying an input signal and output means (168*b*) acting on said actuating pin (36), said actuating signal transforming unit (111) comprising a solenoid (168) with an electromagnetic coil (168*a*) and an armature (168*b*), said armature (168*b*) acting on said actuating pin (36), said electromagnetic coil (168*a*) having electric connection means (170) for being connected to an electric power source.

7. A positioning device comprising:

a housing unit (10, 210) having an axis;

a piston rod (18, 218) axially extending inwards and outwards of said housing unit (10,210);

a piston unit (22, 222) connected to said piston rod (18, 218) within said housing unit (10, 210), said piston rod (18, 218) and said piston unit (22, 222) forming a piston-piston rod unit (18, 22; 218, 222), said piston unit (22, 222) separating two working chambers (12*a*, 12*b*; 212*a*, 212*b*) from each other within said housing unit (10, 210, said working chambers (12*a*, 12*b*; 212*a*, 212*b*) containing a fluid, said working chambers (12*a*, 12*b*; 212*a*, 212*b*) being interconnected by a fluid passage (24*a* to 24*e*; 224*a* to 224*c*), said fluid passage (24*a* to 24*e*; 224*a* to 224c) being selectively closable and openable by valve means (30, 230) allocated to said fluid passage (24a to 24e; 224a to 224c), said valve means (30, 230) being actuable by an actuating member (32, 232) movable with respect to one of said housing unit (210) and said piston-piston rod unit (18, 22); and an actuating signal transforming unit (11) being connected to the respective one of said housing unit (210) and said piston-piston rod unit (18, 22), said actuating signal transforming unit (11) comprising a liquid filled transforming chamber (44) and pressure increasing means (56, 56a) for increasing the pressure of said liquid within said transforming member (44), said actuating member (32, 232) being responsive to pressure rise of said liquid for actuating said valve means (30, 230).

8. A positioning device comprising:

a housing unit having an axis;

a piston rod (18) axially extending inwards and outwards of said housing unit;

a piston unit connected to said piston rod within said housing unit, said piston rod (18) and said piston unit forming a piston-piston rod unit, said piston unit separating two working chambers from each other within said housing unit, said working chambers containing a fluid, said working chambers being interconnected by a fluid passage, said fluid passage being selectively closable and openable by valve mans allocated to said fluid passage, said valve means being actuable by an actuating member (36) movable with respect to one of said housing unit and said piston-piston rod unit (18); and an actuating signal transforming unit (111) being connected to the respective one of said housing unit and said piston-piston rod unit, said actuating signal transforming unit (111) having input means (170) for applying an input signal and output means (168b) acting on said actuating member (36), said actuating signal transforming unit (111) comprising a solenoid (168) with an electromagnetic coil (168a) and an armature (168b), said armature (168b) acting on said actuating member (36), said electromagnetic coil (168a) having electric connection means (170) for being connected to an electric power source.

9. The positioning device as set forth in any one of claims 1, 6, 7 or 8, said actuating signal transforming unit (11, 111) having an adapter housing (38, 138) fastened to the respective one of said housing unit (210) and said piston-piston rod unit (18, 22) outside said housing unit (10, 210).

10. The positioning device as set forth in claim 9, said adapter housing (38, 138) being fastened to the respective one of said housing unit (210) and said piston-piston rod unit (18, 22) by screw means (40, 140).

11. The positioning device as set forth in claim 10, said adapter housing (38, 138) having internal thread means (140a) engaging external thread means (140b) of the respective one of said housing unit (210) and said piston-piston rod unit (18, 22).

12. The positioning device as set forth in claim 1, said input piston (56) and said output piston (48) having respective effective cross-sectional areas exposed to said liquid within said liquid filled transforming chamber (44).

13. The positioning device as set forth in claim 12, said output piston (48) having a smaller effective cross-sectional area than said input piston (56).

14. The positioning device as set forth in claim 12, said output piston having a larger effective cross-sectional area than said input piston.

15. The positioning device as set forth in any one of claims 1, 6, 2, 4, 7 or 8 said actuating signal transforming unit (11, 111) being provided with mechanical connection means (62, 162) for connecting said positioning device to a structural member.

16. The positioning device of any one of claims 1 or 6, said actuating pin (32, 232) extending outwards of the respective one of said housing unit (210) and said piston-piston rod unit (18, 22), said actuating signal transforming unit (11, 111) comprising a cavity (42, 142) accommodating an outer end portion (36, 236) of said actuating pin (32, 232).

* * * * *

UNITED STATES PATENT AND TRADEMARK OFFICE

CERTIFICATE OF CORRECTION

PATENT NO. : 5,097,928

DATED : Mar. 24, 1992

INVENTOR(S) : Enders et al.

It is certified that error appears in the above-identified patent and that said Letters Patent is hereby corrected as shown below:

Title page, Item 56, 11th line, "155478" should read --1554478--.

Col. 6, line 52, "210," should read --210),--.

Col. 9, lines 14-15, "transforming member" should read --transforming chamber--.

Signed and Sealed this

Fifteenth Day of June, 1993

Michael K. Kirk

*Attest:*

MICHAEL K. KIRK

*Attesting Officer*

*Acting Commissioner of Patents and Trademarks*